US006877732B2

(12) United States Patent
Reist et al.

(10) Patent No.: US 6,877,732 B2
(45) Date of Patent: Apr. 12, 2005

(54) FEED CONVEYOR WITH OPENING APPARATUS

(75) Inventors: Walter Reist, Hinwil (CH); Willi Leu, Pfaffikon (CH)

(73) Assignee: Ferag AG, Hinwil (CH)

( * ) Notice: Subject to any disclaimer, the term of this patent is extended or adjusted under 35 U.S.C. 154(b) by 130 days.

(21) Appl. No.: 10/220,783

(22) PCT Filed: Jan. 23, 2001

(86) PCT No.: PCT/CH01/00050

§ 371 (c)(1),
(2), (4) Date: Nov. 4, 2002

(87) PCT Pub. No.: WO01/64561

PCT Pub. Date: Sep. 7, 2001

(65) Prior Publication Data

US 2003/0146558 A1 Aug. 7, 2003

(30) Foreign Application Priority Data

Mar. 3, 2000 (CH) ..... 417/00

(51) Int. Cl.[7] ..... B65H 5/30

(52) U.S. Cl. ..... 270/52.25; 270/52.23; 271/69; 271/205

(58) Field of Search ..... 270/52.14, 52.23, 270/52.25, 52.22, 52.26, 52.29; 271/69, 204, 205, 206

(56) References Cited

U.S. PATENT DOCUMENTS

| | | | | |
|---|---|---|---|---|
| 3,713,650 A | | 1/1973 | Hodgkinson et al. | |
| 4,320,894 A | | 3/1982 | Reist et al. | |
| 5,065,994 A | | 11/1991 | Hatt | |
| 5,112,036 A | * | 5/1992 | Hatt | 270/52.23 |
| 5,248,135 A | | 9/1993 | Leu | |
| 5,269,504 A | * | 12/1993 | Backman | 270/52.2 |
| 5,292,111 A | * | 3/1994 | Hansch | 270/52.27 |
| 5,354,043 A | * | 10/1994 | Reist | 270/52.27 |
| 5,388,816 A | | 2/1995 | Petersen | |
| 5,462,266 A | * | 10/1995 | Meier | 270/52.16 |
| 5,474,286 A | * | 12/1995 | Reist | 270/52.25 |
| 5,485,989 A | | 1/1996 | McCay et al. | |
| 5,596,932 A | * | 1/1997 | Honegger | 101/485 |
| 6,003,859 A | | 12/1999 | Reist | |
| 6,095,511 A | * | 8/2000 | Jager | 270/52.29 |

FOREIGN PATENT DOCUMENTS

| | | |
|---|---|---|
| DE | 640559 | 12/1936 |
| DE | 640 559 | 12/1936 |
| DE | 10 35 572 B | 7/1958 |
| DE | 1035572 | 7/1958 |
| DE | 10 93 296 B | 11/1960 |
| DE | 1093296 | 11/1960 |
| EP | 0 476 859 A2 | 3/1992 |
| EP | 0 572 221 A1 | 12/1993 |
| EP | 0 644 142 A1 | 3/1995 |
| EP | 0 708 042 A1 | 4/1996 |

* cited by examiner

*Primary Examiner*—Patrick Mackey
(74) *Attorney, Agent, or Firm*—Brinks Hofer Gilson & Lione

(57) ABSTRACT

The apparatus has a feed conveyor (12) which is assigned an opening apparatus (18). Located at the downstream end of the feed conveyor (12) is the transfer region (16), through which the movement path (26) of clamps (24) runs. The clamp (24) has two clamp elements (30), which can be moved from an open position into a closed position (60') for gripping and retaining an article (10). The clamp (24) is assigned a holding-open element (28) which, when the article (10) is gripped by means of the clamp (24), ends up between the two parts (22, 22') of the article (10) lifted off from one another by means of the opening apparatus (18), and which is intended for holding the article (10) open when the clamp (24) is closed.

11 Claims, 6 Drawing Sheets

Fig.14
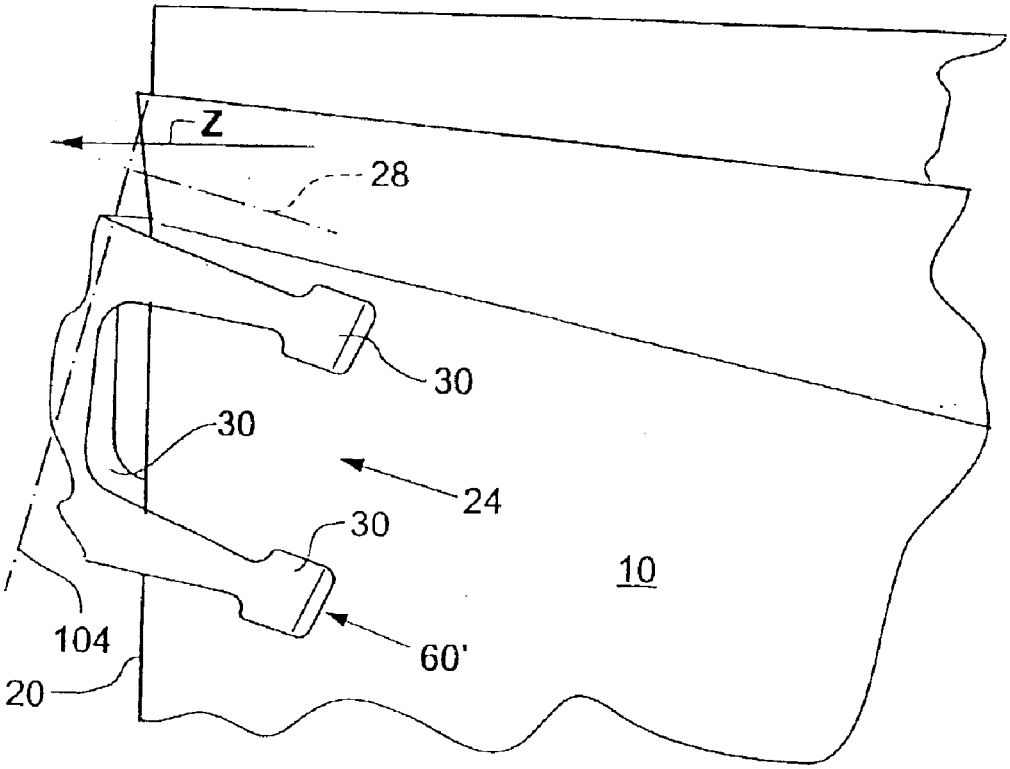
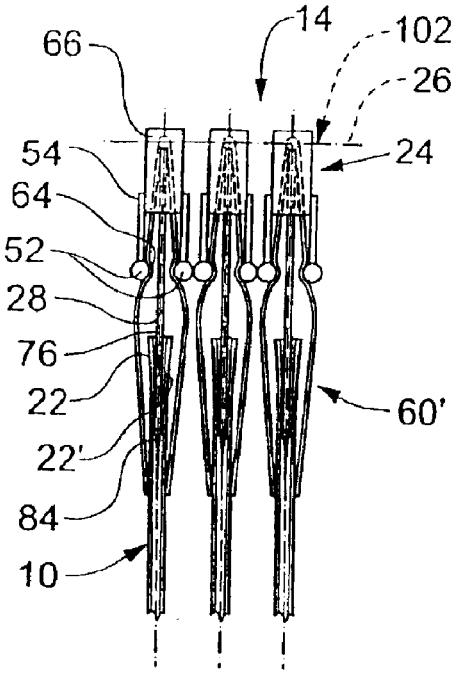
Fig.12
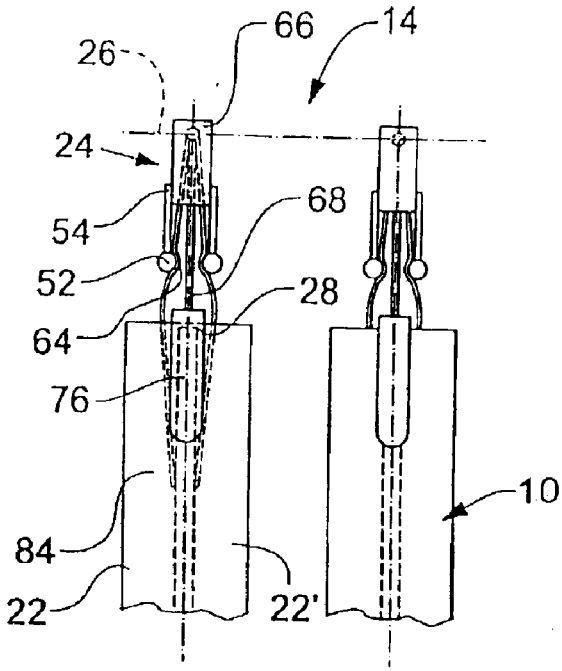
Fig.13

FEED CONVEYOR WITH OPENING APPARATUS

RELATED APPLICATIONS

This application is a nationalization of PCT application PCT/CH01/00050 filed Jan. 23, 2001. This application claims priority from the PCT application and Swiss Patent Application No. 2000 0417/00 filed Mar. 3, 2000.

The present invention relates to an apparatus for processing sheet-like flexible articles with two or more parts according to the preamble of patent claim 1.

An apparatus of this type is disclosed in CH-A-630583 and in the corresponding U.S. Pat. No. 4,320,894. In the region of a feed conveyor designed as a belt conveyor, the articles, printed products, arriving in an imbricated formation are deflected such that they are fed to the downstream end of the feed conveyor in an imbricated formation in which each article rests on the following one. A removal arrangement has a pulling element which is driven in circulation and on which clamps are arranged at constant intervals one behind the other. The clamps are guided past a transfer location at the end of the feed conveyor in the direction from bottom to top in order to grip in each case one fed article from the leading edge and to secure it in order to transport it further. This known apparatus is exclusively suitable for feeding articles arriving in an imbricated formation to the clamps of a clamp transporter.

EP-A-0518063 and the corresponding U.S. Pat. No. 5,292,111 disclose an apparatus for opening folded printed products and depositing them on a saddle-like rest. The printed products are transported in the hanging position by means of a feed conveyor which has clamps arranged at constant intervals one behind the other on a pulling element. Arranged beneath the feed conveyor is an opening arrangement, by means of which the printed products retained by the clamps at the fold are to be opened at their edge which is located opposite the fold. Arranged downstream of the opening apparatus, as seen in the conveying direction of the feed conveyor, is a processing arrangement with saddle-like rests on which, by virtue of the clamps being opened, the previously opened printed products are deposited in straddling fashion. Between the opening arrangement and the processing arrangement, the opened printed products are held open by means of holding-open bars, which engage from one side between the parts of the printed products which are lifted off from one another. The holding-open bars are fastened on a circulating pulling element which is arranged laterally alongside the feed conveyor.

It is an object of the present invention to provide an apparatus of the generic type which makes it possible for the articles to be opened and for the opened articles to be transported further in the opened state.

This object is achieved by an apparatus which has the features of claim 1.

Preferred embodiments of the apparatus according to the invention are specified in the dependent claims.

The invention will be explained with reference to exemplary embodiments illustrated in the drawing, in which, purely schematically:

FIG. 12 shows a plurality of clamps, each retaining an article, with a holding-open element in a portion of the movement path of the clamps which is defined as a buffer-storage section;

FIG. 13 shows, in the same illustration as FIG. 12, two clamps, each retaining an article, with the holding-open element moved into the spreading position; and FIG. 14 shows part of a clamp with an article retained by it, the clamp being arranged obliquely in relation to that edge of the article which is directed toward it.

Figure 1:
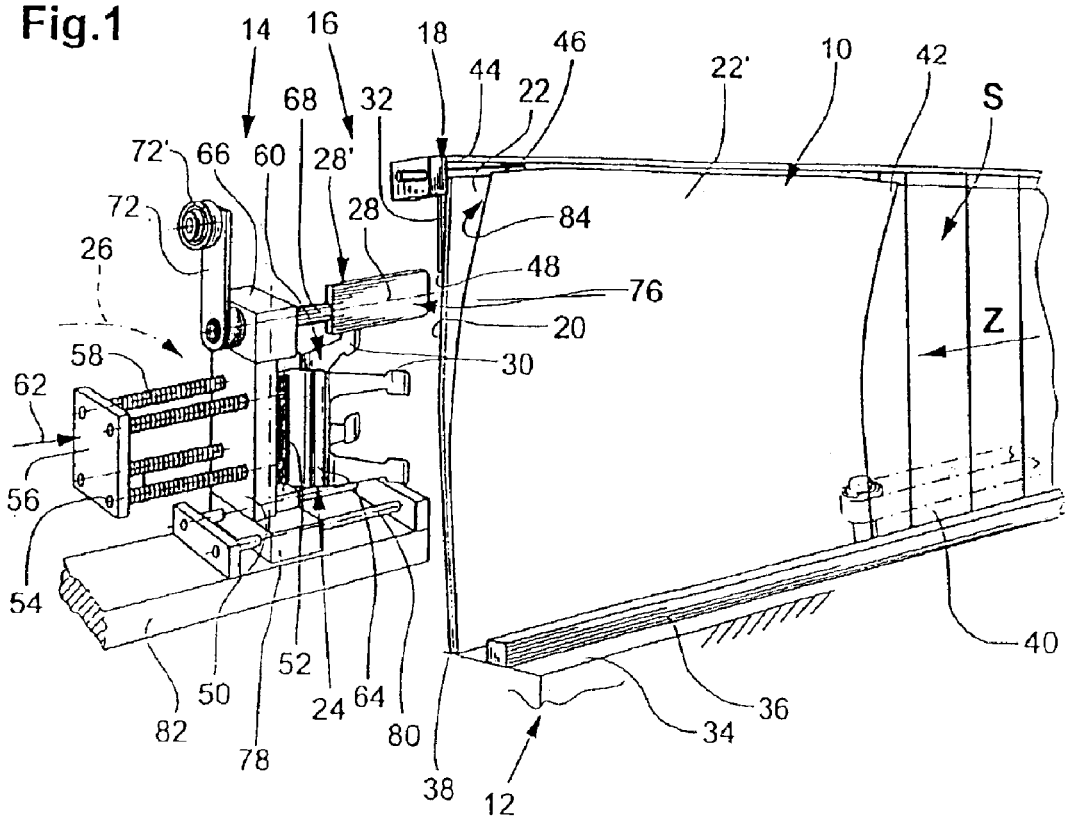
FIG. 1 shows a perspective illustration of an apparatus with a feed conveyor and a clamp with a holding-open element of a removal arrangement, which is ready for gripping an article.
Figure 2:
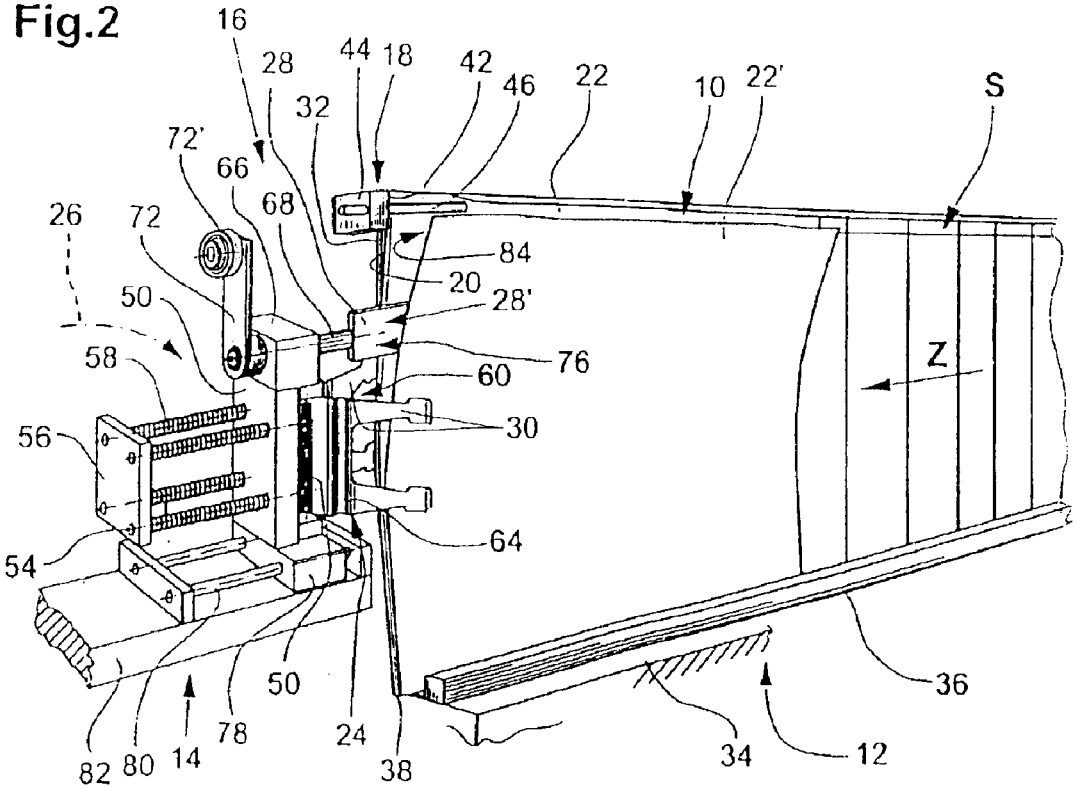
FIG. 2 shows, in the same illustration as FIG. 1, the feed conveyor shown in FIG. 1 and the clamp during the operation of grasping the article.

The apparatus shown in FIGS. 1 to 6 for processing flexible, sheet-like articles 10, in the present case folded printed products, with two or more parts, has a feed conveyor 12 and a removal arrangement 14. By means of the feed conveyor 12, articles 10 arriving in an imbricated formation S are to be fed in the feed direction Z to a transfer region 16 at the downstream end of the feed conveyor 12. The feed conveyor 12 is assigned, at the downstream end, an opening apparatus 18, which is intended for opening the articles 10 in a region of the leading edge 20, as seen in the conveying direction Z, that is to say, in this region, for lifting off two previously abutting, sheet-like parts 22, 22' of the article 10 from one another at least in certain regions.

The removal arrangement 14 has a plurality of clamps 24, of which in each case only one is shown in FIGS. 1 to 4 and which are arranged one behind the other along a movement path 26 and are driven in circulation in the arrow direction. Each clamp 24 is assigned a holding-open element 28, which serves as the holding-open means 28' and is intended for engaging between the two parts 20, 20' lifted off from one another by means of the opening apparatus 18 and for keeping these parts separate from one another outside the region of action of the clamp element 30 and thus for holding the relevant article 10 open.

The feed conveyor 12 has a supporting wall 32, which is inclined slightly in relation to a vertical and against which the articles arranged in imbricated formation S butt with their surface areas. As seen in the feed direction Z, each of the articles 10 rests on the respectively following one. The horizontally running bottom edge of the supporting wall 32 is joined by a base element 34, on which a guide strip 36 is fastened. The latter runs parallel to the supporting wall 32 and, together with the latter, forms a guide groove for the fold edge 38 of the folded articles 10, the latter butting against the base element 34 by way of said fold edge. Arranged above the guide strip 36 is a conveying belt 40 which is driven in circulation in the feed direction Z and, together with the supporting wall 32, forms a conveying nip for the articles 10. The conveying belt 40 is intended for feeding the articles to the transfer region 16 in the feed direction Z.

As can be gathered from FIGS. 1 to 3 and 6 in particular, the articles 10 are folded eccentrically, in which case the part 22, which is directed toward the supporting wall 32, has a so-called overfold 42, which projects beyond the other part 22', on the side which is located opposite the fold edge 38. Each of the parts 22, 22' may have one or more sheets.

The opening apparatus 18 is fastened on the supporting wall 32 at the downstream end, as seen in the feed direction Z. The opening apparatus has a stop element 44 and a guide pin 46 fastened on the latter. The guide pin projects from the stop element 44 counter to the feed direction Z and is curved such that, together with the planar supporting wall 32, as seen in the feed direction Z, it forms a tapering guide nip which is terminated at the downstream end by means of the stop element 44.

Between the base element 34 and the opening apparatus 18, the supporting wall 32 has a cutout 48 which runs from the downstream end and allows the clamp elements 30 to have access to the respectively foremost article of the imbricated formation S, as seen in the feed direction Z.

The two clamp elements 30 are formed by the legs of a spring-steel sheet which is bent in a V-shaped manner and is fastened on a guide element 50 in the region of its bend. A circular-cylindrical closing body 52 is arranged on the outside of each clamp element 30. Each of the closing bodies is fastened on two flexurally rigid guide bars 54, the mutually parallel guide bars 54 being mounted on the guide element 50, such that they engage through the latter, and are connected to one another by means of an actuating plate 56 at the ends remote from the closing bodies 52. A compression spring 58 engages around each of the guide bars 54 and is supported, on the one hand, on the guide element 50, and, on the other hand, on the actuating plate 56. In the open position 60 of the clamping elements 30, the position being shown in FIGS. 1 and 2, the closing bodies 52 are held in abutment against the guide element 50 by the compression springs 58. In order to move the clamp elements 30 into their closed position 60'—see FIGS. 3 and 4—the actuating plate 56 is moved in the direction of the guide element 50 by means of a closing control mechanism 62. The closing bodies 52 thus slide along the clamp elements 30, on the outer side of the latter, and pivot them into the closed position 60'. In this closed position 60', the closing bodies 52 are located approximately centrally between the guide element 50 and the free end of the clamp elements 30, ending up there in a latching depression 64 formed on the clamp elements 30. They are retained in a stable manner in said latching depression such that the compression springs 58 are not able to move the closing bodies 52 out of the latching depression 64. In order to open the clamp 24, the actuating plate 56 is moved away from the guide element 50 by means of an opening control mechanism 62 (not shown).

In the position of the clamp 24 which is shown in FIGS. 1 to 4, a bearing body 66 is fastened at the top end of the guide element 50. This bearing body has a shank 68 engaging through it, the shank running parallel to the guide bars 54 and having the tongue-like holding-open element 28 fastened on its end side, on the side which is directed toward the feed conveyor 12. The holding-open element is mounted on the bearing body 66 such that it can be rotated about its longitudinal axis, which coincides with the shank 68. On the other side of the bearing body 66, in respect of the holding-open element 28, a control lever 72 is seated on the shank 68, a control roller 72' being mounted in a freely rotatable manner at the free end of the said control lever. By virtue of a control element 74 (FIG. 4) acting on said control roller 72', the holding-open element 28 can be moved through approximately 90° from a holding-open position 76—FIGS. 1 to 3—in which the longer extent of the cross section is located in or parallel to the clamp plane defined by the clamp element 30 located in the closed position 60', into a spreading position 76' (FIG. 4) and back again. The control element 74 may be, for example, a stationary guide element which acts on the control roller 72' when the clamp 24 is moved along its movement path 26.

On the side which is directed away from the bearing body 66, the guide element 50 is fastened on a slide 78. The latter has two guide rails 80 engaging through it, these rails running parallel to the longitudinal axis of the holding-open element 28 and to the guide bars 54. The guide rails 80 are fastened on a carrier 82, which may be fastened, for example, on a carrier wheel, on a pulling element or on a carriage guided in a guide profile.

The apparatus shown in FIGS. 1 to 6 operates as follows: the position of the articles 10 in the imbricated formation S, the conveying speed of the feed conveyor 12 and the movement of the clamps 24 along their movement path 26 are coordinated with one another such that each clamp 24 can grip an article 10 as it moves through the transfer region 16. These abovementioned movements preferably take place continuously.

During advancement by means of the conveying belt 40, the foremost article 10 of the imbricated formation S, as seen in the feed direction Z, passes, by way of its overfold 42, in the guide nip formed by the supporting wall 32 and the guide pin 46 and comes into abutment against the stop element 44 by way of its leading edge 20. The conveying belt 40, however, moves the article 10 further in the feed direction Z with the result that the part 22 of the article 10, said part being directed toward the supporting wall 32, bends away from the supporting wall 32 at the leading edge 20 and in a region adjacent to the latter, see FIG. 5. As a result of the inherent stability of the material of the article 10, the part 22' is thus lifted off from the part 22 at the leading edge 20. This results in an opening 84 in the article 10 in a portion of the leading edge which is remote from the base region and at the overfold 42.

As soon as this opening 84 is present, the clamp 24, with the holding-open elements 28 located in the open position 60, is moved toward the feed conveyor 12 in the direction counter to the feed direction Z. For this purpose, the closing control mechanism 62 acts on the actuating plate 56, FIG. 1.

For the time being, however, as a result of the action of the compression springs 58, the clamp 24, rather than being closed, is moved on the guide rails 80 in the direction of the feed conveyor 12 in relation to the carrier 82. In this case, the wide-open clamp elements 30 grasp the article 10 from the leading edge 20. At the same time, the holding-open element 28 has moved into the opening 84 of the article 10.

Figure 3:
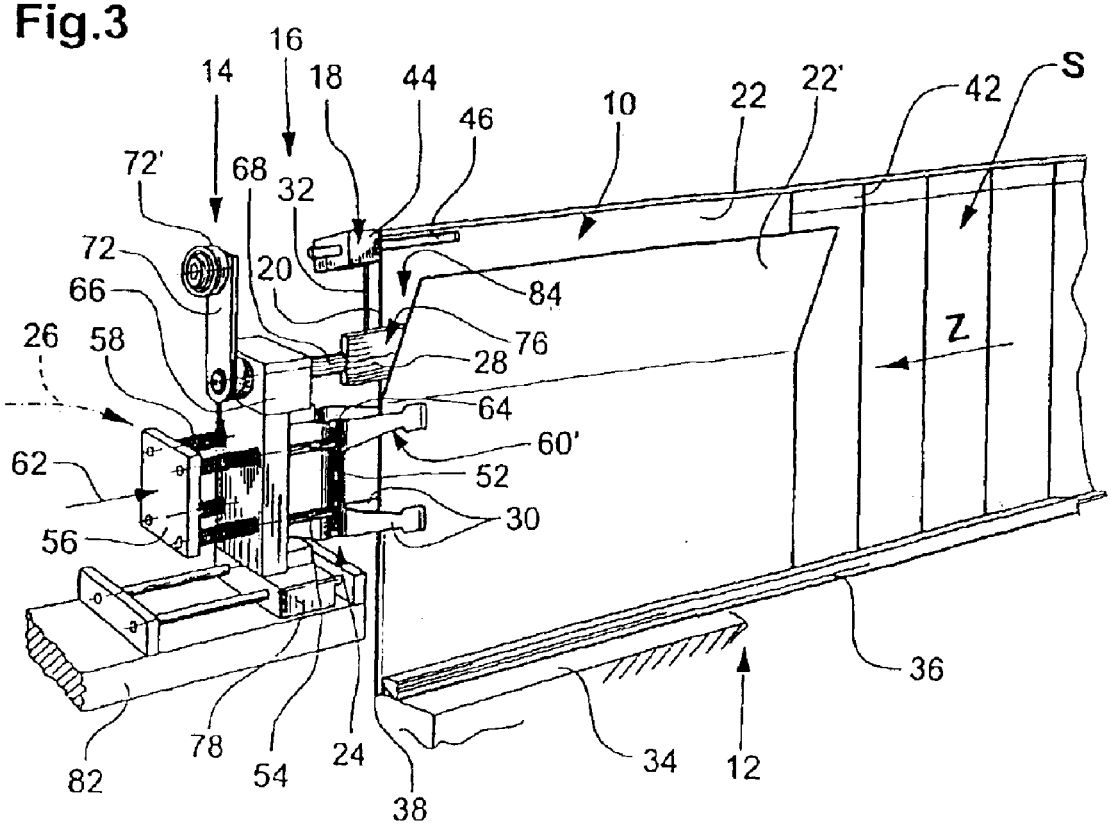
FIG. 3 shows the feed conveyor and the clamp in the same illustration as FIGS. 1 and 2, the clamp having gripped the article.

As soon as the slide 78 comes into abutment against a stop arranged on the carrier 82, the closing bodies 52 are then moved, under the continued action of the closing control mechanism 62, in the direction of the free end of the clamp elements 30, which causes these clamp elements 30 to be transferred into the closed position 60', FIG. 3. As a result, the relevant article 10 is closed along the leading edge 20 beneath the holding-open element 28, which helps to increase the angle of the opening 84.

As a result of the clamp 10 being moved along the movement path 26, which runs at least more or less at right angles to the supporting wall 32 in the transfer region 16, the article 10 gripped by the clamp 24 is moved away from the feed conveyor 12. As can be gathered from FIG. 6, the overfold 42 here is pulled out from under the guide pin 46. It can also be gathered from this figure that the respectively following article 10 assists the operation of opening the preceding article 10 in that the part 22 is forced away from the supporting wall 32.

Figure 4:
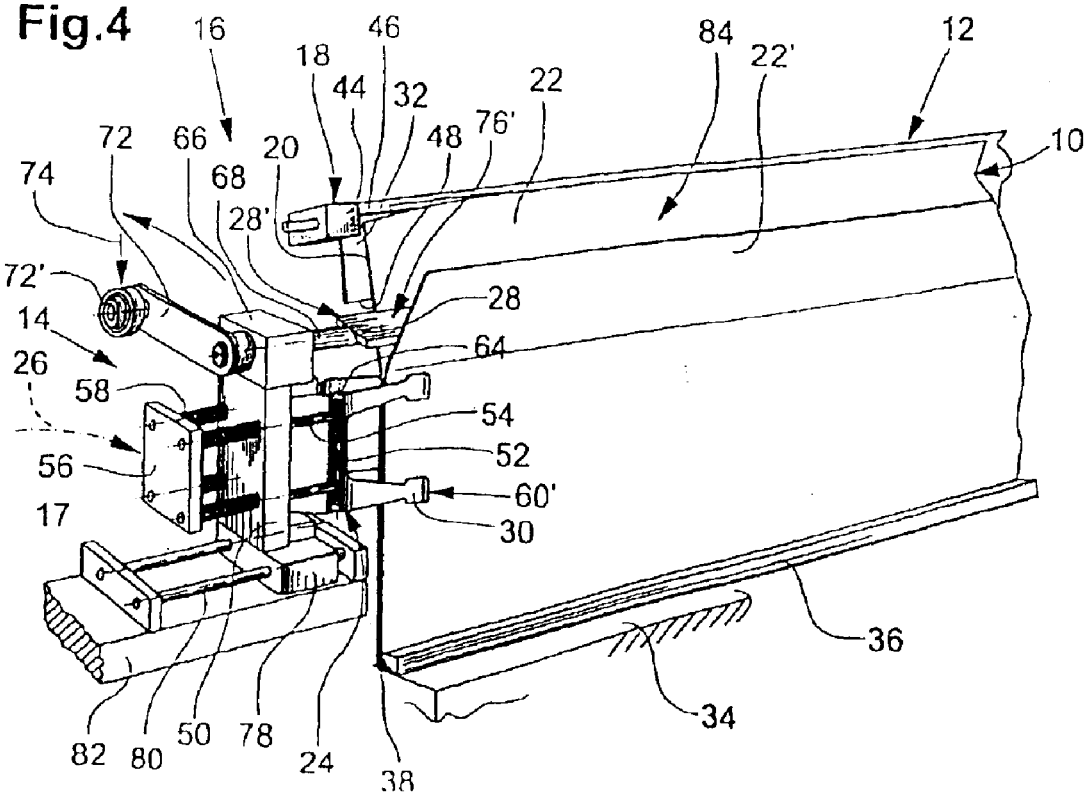
FIG. 4 shows the feed conveyor and the clamp in the same illustration as in FIGS. 1 to 3, the clamp conveying the gripped article away from the feed conveyor, and the holding-open element, arranged between two parts of the article, being moved into a spreading position in order to open the article further.
Figure 5:
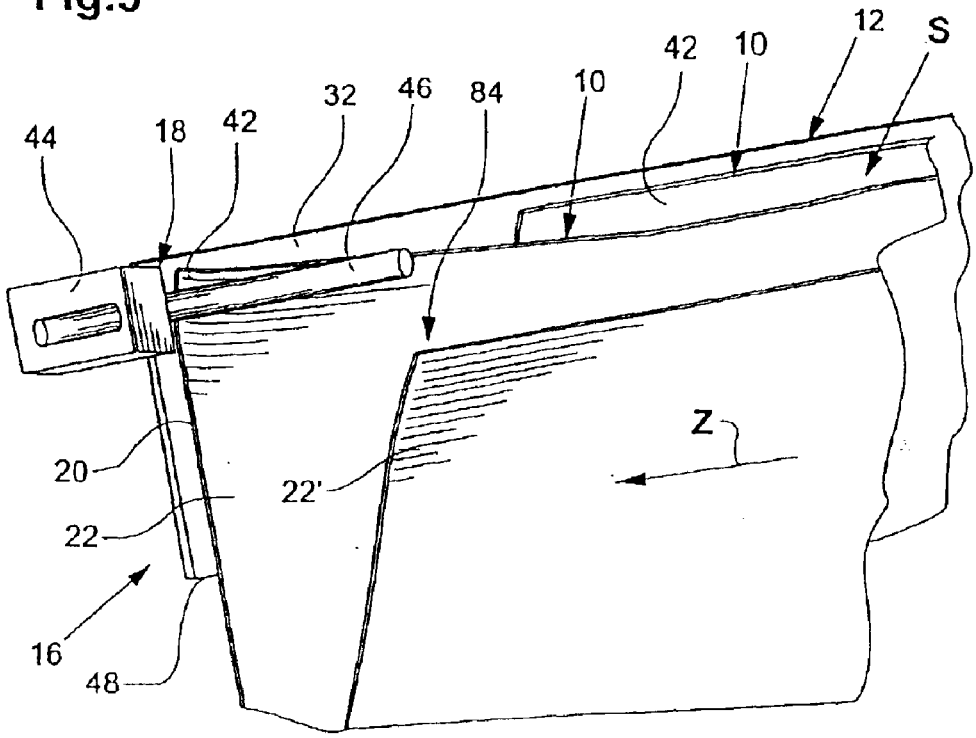
FIG. 5 shows, in the same illustration as FIGS. 1 to 4, part of the feed conveyor with an opening arrangement.
Figure 6:
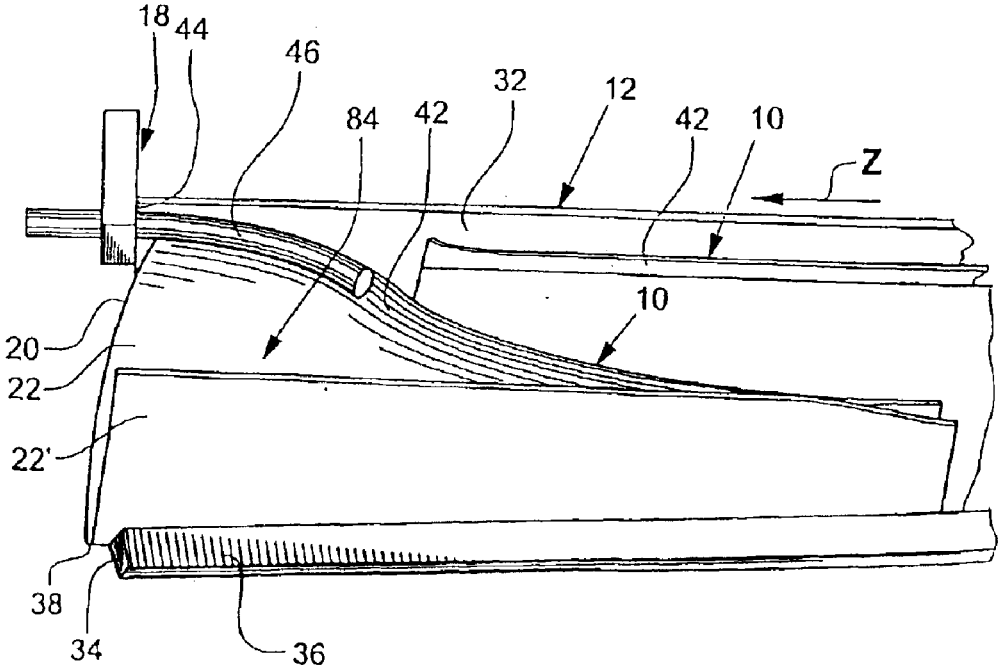
FIG. 6 shows a plan view of that part of the feed conveyor which is shown in FIG. 5.

In the position shown in FIG. 4, the article 10 retained by the clamp 24 has been moved away from the supporting wall 32, while the fold edge 38 is still located between the guide strip 36 and the supporting wall 32; this is the case because, in the example shown, the movement path 26 runs in a circle about an axis which runs between the supporting wall 32 and the guide strip 36, at least more or less, at the base element 34. This results in the articles 10 being rotated, at least more or less, about their fold edge 38 by means of the clamps 24. This will be explained further at a later stage in the text in conjunction with FIG. 11 of course, it is also possible for the clamps 24 to be transported along differently defined movement paths 26, as is explained hereinbelow, with reference to FIGS. 12 and 13.

Figure 7:
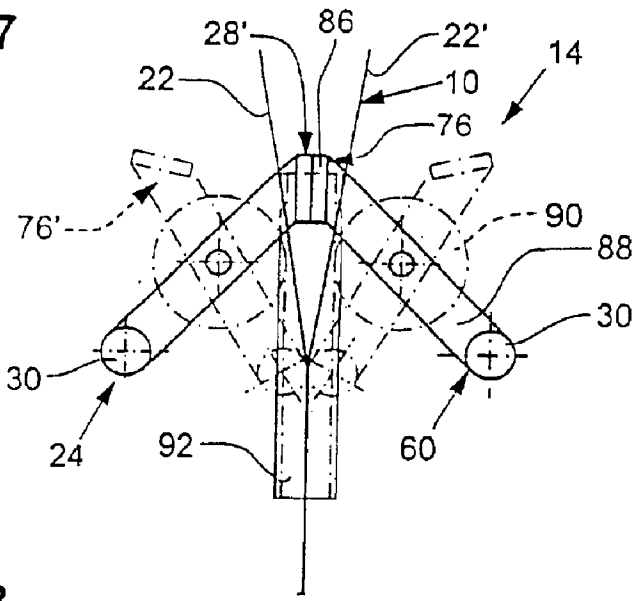
FIG. 7 shows a side view of a further embodiment of the clamp in the open position and with holding-open bars.
Figure 8:
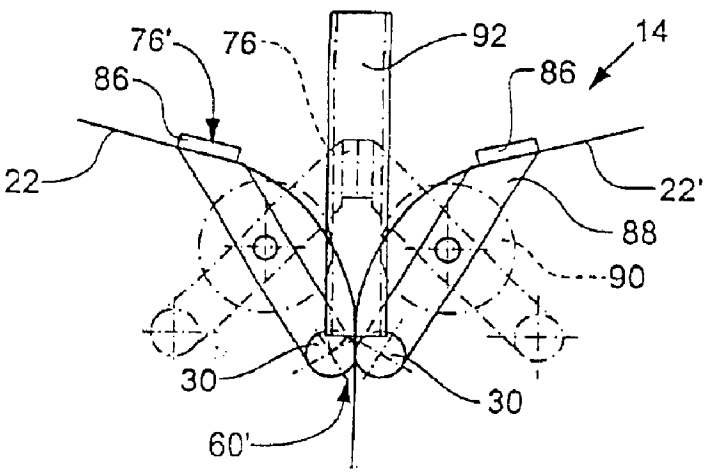
FIG. 8 shows, in the same illustration as FIG. 7, the clamp shown in FIG. 7, but this time in the closed position.

FIGS. 7 and 8 show a second embodiment of the clamp 24 with a holding-open element 28 acting as holding-open means 28'; the latter is formed by two holding-open bars 86, which butt against one another in the open position 60 of the clamp 24 (FIG. 7). Each of the holding-open bars 86 projects from a double-armed lever 88, at the other end of which a cross-sectionally circular-cylindrical clamp element 30 is arranged. The clamp elements 30 run parallel to the holding-open bars 86 and parallel to the axes of the levers 88. Each lever 88 is connected in a rotationally fixed manner to a gearwheel 90, between which there is arranged a rack 92 which meshes with the two gear wheels 90. Both the levers 88 and the rack 92 may be mounted by a guide element in a manner analogous to the guide element 50 of the embodiment described above. The rack 92 is prestressed into the open or closed position 60, 60', for example, by means of a spring element and is displaced into the respectively closed or open position 60', 60, counter to the spring action, by means of a corresponding control element, for example a guide element or some other generally known drive means. The movement of the rack 92 is transmitted, via the gearwheels 90, to the clamp elements 30 and holding-open bars 86. FIG. 7 also shows an article 10, which is likewise an opened multi-leaf printed product, the holding-open bars 86 engaging in the opening 84 between the two parts 22, 22' from the leading edge (see FIGS. 1 to 4). Correspondingly, the clamping elements 30 are located in a spaced-apart open position 60, which is illustrated by solid lines in FIG. 7 and chain-dotted lines in FIG. 8.

If the clamp elements 30 are moved into the closed position 60', FIG. 8, they clamp the article 10 firmly between them while, at the same time, the two holding-open bars 86 have been transferred into the spreading position 76', as a result of which the size of the opening 84 between the parts 22, 22' has been increased to a considerable extent. This takes place during the closing operation of the clamp 24.

Figure 9:
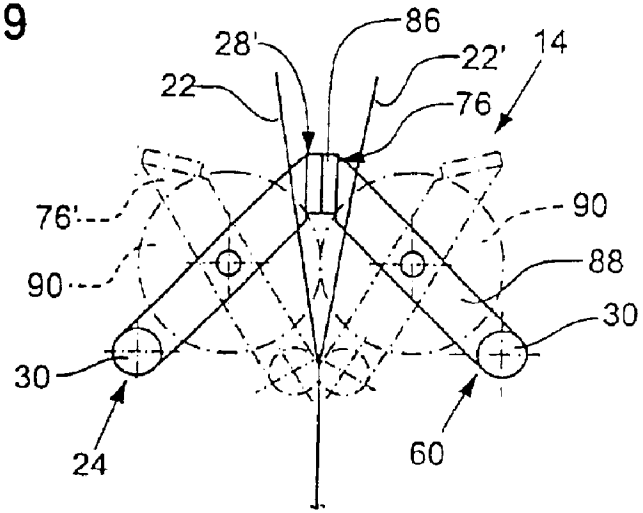
FIG. 9 shows a third embodiment of the clamp in the open position and with holding-open bars.
Figure 10:
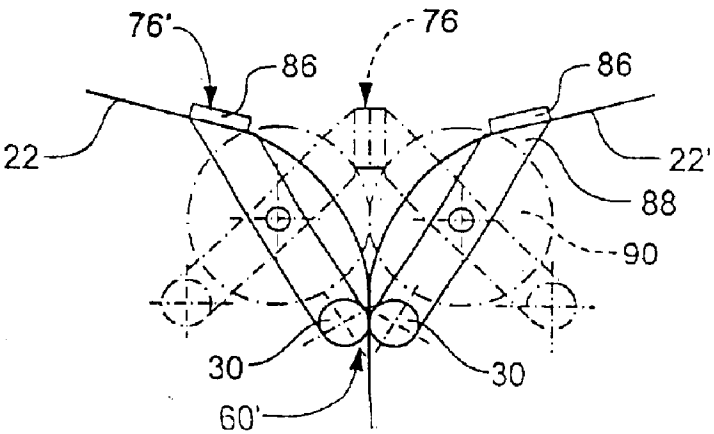
FIG. 10 shows, in the same illustration as FIG. 9, the clamp shown in FIG. 9, but this time in the closed position.

FIGS. 9 and 10 show a further embodiment which is very similar to the embodiment shown in FIGS. 7 and 8. The holding-open bars 86, on the one hand, and the clamp elements 30, on the other hand, are fastened on two levers 88, which are likewise mounted in an axis-parallel manner. These clamp elements, the holding-open bars 86 and axes of the levers 88 run parallel to one another. Each of the levers 88 is connected in a rotationally fixed manner to a gearwheel 90, the two gearwheels meshing with one another. FIG. 9 shows an article 10 which has been opened by means of the opening apparatus 18 and between the parts of which the holding-open bars 86, located in the holding-open position 76, engage, FIG. 9. By virtue of the gearwheels 90 being rotated correspondingly, the clamp elements 30 are moved from the holding-open position 60 into the closed position 60' while, at the same time, the holding-open bars 86 are transferred from the holding-open position 76, in which they butt against one another, into the spreading position 76', FIG. 10. The gearwheels 90 may be rotated by generally known drive means.

Figure 11:
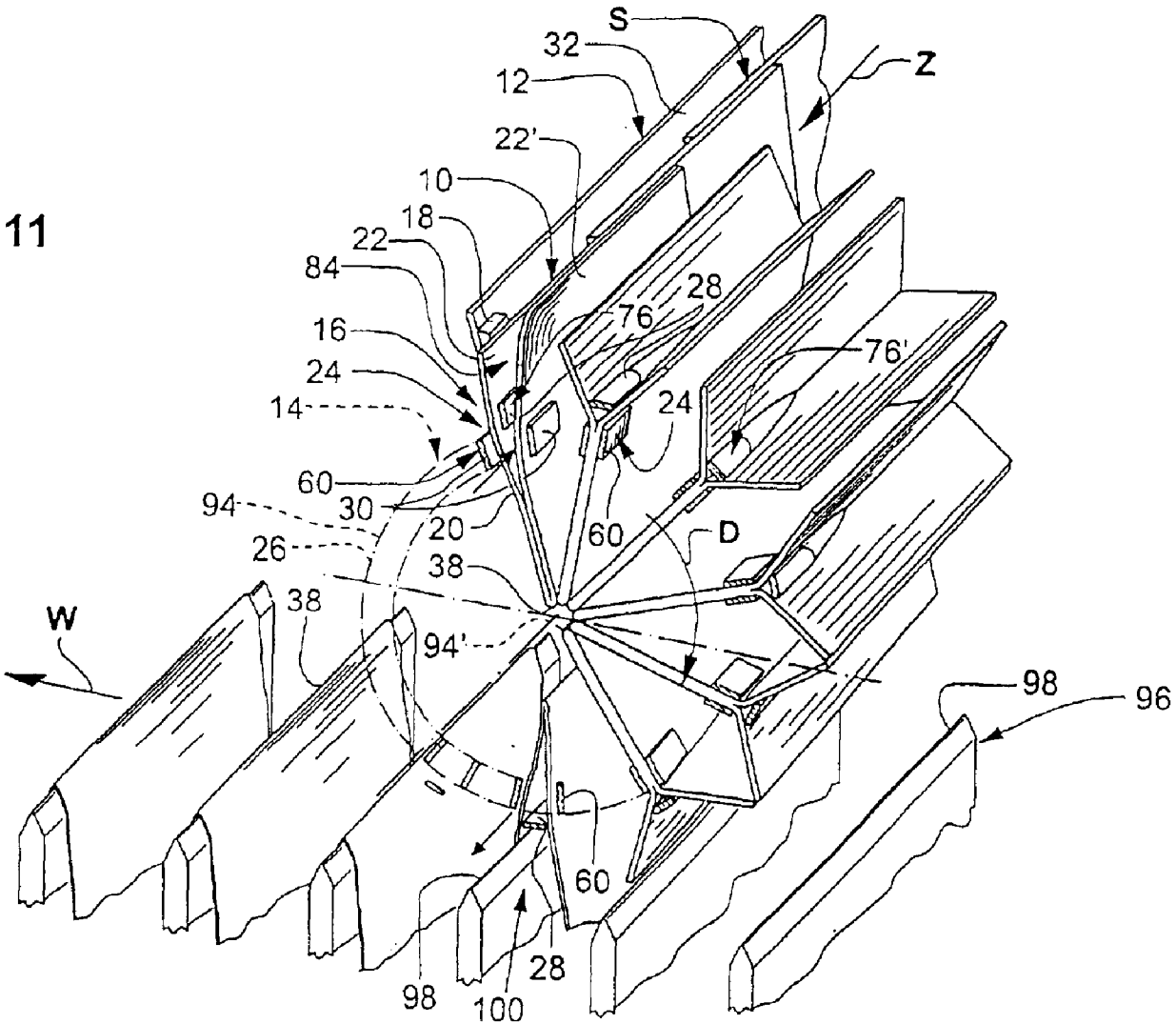
FIG. 11 shows a perspective illustration of the feed conveyor according to FIGS. 1 to 6 and a multiplicity of clamps which circulate along a circular movement path and are intended for feeding the gripped articles to a processing arrangement and transferring them to the latter.

The feed conveyor 12 shown in FIG. 11 is of the same configuration, in terms of design and functioning, as the feed conveyor shown in FIGS. 1 to 6. The carriers of a multiplicity of clamps 24, as are shown in FIGS. 1 to 4, are fastened in a uniformly distributed manner on a schematically indicated carrier wheel 94. The axis of rotation 94' of the carrier wheel 94 runs parallel to the supporting wall 32 in the feed direction Z, as seen in the vertical direction, level with the base element 34. Of the clamps 24, only the clamp elements 30 and the holding-open element 28 are illustrated. The direction of rotation of the carrier wheel, and thus the movement direction of the clamps 24, is indicated by an arrow D. Arranged beneath the removal arrangement 14 with the clampss 24 is a processing arrangement 96, which has saddle-like rests 98 which are arranged in the manner of ladder rungs on mutually parallel pulling elements (not shown). The longitudinal direction of the saddle-like rests 98 is parallel to the axis of rotation 94' of the carrier wheel 94. In a transfer region 100, beneath the carrier wheel 94, the removal direction W, in which the saddle-like rests 98 are moved, corresponds to the movement direction D of the clamps 24, the conveying speed of the saddle-like rests 98 corresponding at least more or less to the circulatory speed of the clamps 24. The spacings between the saddle-like rests 98 and the clamps 24 are coordinated with one another such that a saddle-like rest 98 coincides with each clamp 24 in the transfer region 100.

The embodiment shown in FIG. 11 functions as follows: the articles 10 fed to the transfer region 16 in imbricated formation S by means of the feed conveyor 12 are opened by means of the opening apparatus 18, in each case one clamp 24 engaging around an article 10 from the leading edge 20 and the associated holding-open element 28 moving into the opening 84 formed by the parts 22, 22' which are lifted off from one another. This takes place in a manner analogous to that described in conjunction with FIGS. 1 to 6. The clamp elements 30 are then closed and the holding-open element 28 is rotated through 90° from the holding-open position 76 into the spreading position 76', as is shown with reference to the clamps 24 each retaining an article 10. As a result, that portion of the parts 22, 22' which is located radially outside the region of action of the clamps 24 is spread apart in a pronounced V-shaped manner, an enlarged opening 84 being formed in the process. Mutually facing parts 22, 22' of the articles 10 retained by adjacent clamps 24 may even be in contact with one another in this spreading position 76'. As a result of the spreading position 76, the articles 10 may be brought into mating engagement with the saddle-like rests 98 at a high processing speed. Approximately vertically beneath the axis of rotation 94', the clamp elements 30 are moved into the open position 60 and the entire clamp 24, together with the holding-open element 28, is moved out of the region of the article 10 in the direction of the axis of rotation 94', with the result that said article ends up located in straddling fashion on the relevant saddle-like rest 98. Downstream of the transfer region 100, as seen in the direction of rotation D, the holding-open element 28 is then moved into the holding-open position 76 again.

The articles 10 retained by the clamps 24 form, as it were, half a pocket wheel, the individual pockets being formed by the articles 10 themselves. It is easily possible for the articles 10, which are fed one behind the other in imbricated formation S or individually, to be fed to a processing arrangement 96 in the manner shown. A plurality of feed conveyors 12 with associated removal arrangements 14 may be provided in the removal direction W in order to collect folded articles 10.

If the clamps 24 are moved along their movement path 26 such that the fold edges 38 end up located beneath the corresponding clamps 24, it is possible, in a known manner, for an insert or a trade sample to be introduced into the held-open and spread-apart articles 10.

It is conceivable for the clamps 24 to circulate to the side of the saddle-like rests 98, as seen in the removal direction W. In this case, a portion of the movement path 26 of the clamps 24 may run beneath the movement path of the top edge of the saddle-like rests 98.

FIG. 12 shows, in a view from above, three clamps 24, each retaining an article 10, in the closed position 60', as are shown in FIGS. 1 to 4. These clamps 24 are located in a portion of the movement path 26 which is arranged downstream of the transfer region 16 and in which the articles 10 are retained with the fold edge 38 located at the top. Since the holding-open elements 28 are located in the holding-open position 76, it is possible for the clamps 24 to be in contact with one another in a space-saving manner. The relevant portion of the movement path 26 forms a buffer-storage section 102. In this case, the carriers 82 (see FIGS. 1 to 4) are preferably arranged on a carriage in each case, it being possible for the carriages to be moved freely along a rail.

FIG. 13 shows two clamps 24 retaining an article 10 in the same manner as in FIG. 12, although in this case the spacing between the clamps 24 has been increased and the tongue-like holding-open element 28 has moved into the spreading position 76'. As a result, the size of the opening 84 bounded by the parts 22 and 22' has been increased to a considerable extent in comparison with that in the case of the holding-open element 28 being located in the holding-open position 76, this allowing different processing operations.

FIG. 14 shows the clamp elements 30 of a clamp 24 located in the closed position 60'. The chain-dotted straight line 104 indicates the throat of the clamp mouth formed by the clamp elements 30. This throat runs at right angles to the longitudinal axis of the tongue-like holding-open element 28, said longitudinal axis likewise being indicated by chain-dotted lines. As can clearly be gathered from FIG. 14, the throat 104 encloses an acute angle with the edge 20 of the article 10 retained. This can be achieved, for example in the case of an apparatus according to FIGS. 1 to 4 and 11, in that the carriers 82 of the clamps 24 are likewise arranged at a corresponding acute or obtuse angle in relation to the feed direction Z. This operation of gripping the article 10 obliquely in relation to the edges of the article 10 causes the article 10 to be opened to a greater extent as its distance from the clamp 24 increases. This may be particularly advantageous, for example, for depositing the articles 10 on saddle-like rests 98 of the processing arrangement 96.

Folded printed products are processed in the exemplary embodiments shown above. It is also possible, however, to process multi-sheet stapled or bound printed products. It is also conceivable to process articles 10 which have two or more parts and, rather than being connected to one another, butt against one another with their surface area in the region of the feed conveyor 12.

The opening apparatus 18 shown is advantageously suitable for opening eccentrically folded articles 10 in the center. The feed conveyor 12 may be assigned generally known opening apparatuses which are constructed and function differently, as are known, for example, from EP-A-0 574 741, U.S. Pat. No. 5,441,245, CH-A-641 113, CH-A-644 815 and U.S. Pat. No. 4,420,146.

Other different embodiments of the clamp with a holding-open element 28 are also conceivable. In particular, it may not be necessary for the holding-open element 28 to be designed such that it can be moved from a holding-open position 76 into a spreading position 76'.

What is claimed is:

1. An apparatus for processing flexible, articles with two or more parts, comprising:

a feed conveyor for feeding articles, one after the other, to a transfer location, and a removal arrangement including clamps which are arranged, one behind the other, and are driven along a movement path running past the transfer location, said clamps intended for gripping in each case one article at the transfer location and securing the one article in order to transport it further, wherein the feed conveyor is assigned an opening apparatus which is intended for opening the articles, at least in certain regions, by lifting off at least one of the two parts of the respective article from another, and wherein the removal arrangement includes a holding-open device which is intended for engaging between the parts of the respective article lifted off from one another by the opening apparatus, which runs along with the clamps and holds the article open as it is transported further.

2. The apparatus as claimed in claim 1, wherein each clamp has one said holding-open device.

3. The apparatus as claimed in claim 2, wherein the holding-open device can be moved from a holding-open position into a spreading position in order for the article retained by the relevant clamp to be opened further outside the region of action of the clamp.

4. The apparatus as claimed in claim 1, wherein the opening apparatus is arranged at the downstream end of the feed conveyor and is intended for opening the articles in a section of the leading edge, as seen in the conveying direction of the feed conveyor.

5. The apparatus as claimed in claim 4, wherein the movement path of the removal arrangement runs past the end of the feed conveyor in a direction transverse to the conveying direction of the feed conveyor and the clamps, at the transfer location, are arranged in the direction counter to the conveying direction of the feed conveyor, in order to grasp the articles from the leading edge.

6. The apparatus as claimed in claim 1, wherein the clamps and the holding-open device are arranged in a movable manner on a carrier, guided along the movement path, such that, at the transfer location, they can be moved relative to the movement path in the direction of the feed conveyor.

7. The apparatus as claimed in claim 1, wherein the feed conveyor and, in the direction of the movement path, the clamps are driven continuously.

8. The apparatus as claimed in claim 7, wherein the continuous movement path runs in a plane that is arranged at right angles to the conveying direction of the feed conveyor.

9. The apparatus as claimed in claim 1 or 8, wherein a processing arrangement having saddle rests is arranged beneath the removal arrangement, and in a transfer region the movement direction and speed of the clamps and of the saddle rests are at least more or less equal, such that the opened articles come into mating engagement with in each case one saddle rest.

10. The apparatus as claimed in claim 1 or 5, wherein the feed conveyor has a more or less vertical supporting wall, the articles being transported in abutment against the wall, and a base element, on which the articles rest by way of an edge running in the conveying direction, the opening apparatus being spaced apart from the base element and the movement path running past the downstream end of the supporting wall, at least more or less at right angles to the latter.

11. The apparatus as claimed in claim 1, wherein the clamp has a clamp mouth, of which the throat, at the transfer location, runs at an acute or obtuse angle in relation to the conveying direction of the feed conveyor.

* * * * *